US005342744A

United States Patent [19]

Wariishi

[11] Patent Number: 5,342,744

[45] Date of Patent: Aug. 30, 1994

[54] SILVER HALIDE PHOTOGRAPHIC MATERIAL

[75] Inventor: Koji Wariishi, Kanagawa, Japan

[73] Assignee: Fuji Photo Film Co., Ltd., Kanagawa, Japan

[21] Appl. No.: 124,586

[22] Filed: Sep. 22, 1993

[30] Foreign Application Priority Data

Sep. 25, 1992 [JP] Japan ..... 4-256630

[51] Int. Cl.[5] ..... G03C 1/825

[52] U.S. Cl. ..... 430/522; 430/517; 430/595; 430/510; 430/513; 430/139

[58] Field of Search ..... 430/522, 517, 595, 510, 430/513, 139

[56] References Cited

U.S. PATENT DOCUMENTS

| | | | |
|---|---|---|---|
| 4,288,534 | 9/1981 | Lemahieu et al. | 430/522 |
| 4,855,221 | 8/1989 | Factor et al. | 430/510 |
| 4,956,269 | 9/1990 | Ikeda et al. | 430/522 |
| 5,204,232 | 4/1993 | Sato et al. | 430/522 |
| 5,227,284 | 7/1993 | Matsushita et al. | 430/513 |
| 5,238,798 | 8/1993 | Usami | 430/522 |
| 5,238,799 | 8/1993 | Usami et al. | 430/517 |

*Primary Examiner*—Thomas R. Neville

*Attorney, Agent, or Firm*—Sughrue, Mion, Zinn, Macpeak & Seas

[57] ABSTRACT

A photographic material including a hydrophilic colloid layer containing a dispersion of dye is disclosed. The dye colors a specific layer in the photographic material without diffusing to other layers during storage, yet is quickly decolored or eluted during development processing.

18 Claims, No Drawings

SILVER HALIDE PHOTOGRAPHIC MATERIAL

FIELD OF THE INVENTION

The present invention relates to a silver halide photographic material having a colored hydrophilic colloid layer and, more particularly, to a silver halide photographic material having a hydrophilic colloid layer containing a dye which is photochemically inactive and readily decolored and/or eluted during a photographic processing step.

BACKGROUND OF THE INVENTION

In a silver halide photographic material, a photographic emulsion layer and the other hydrophilic colloid layers are often colored in order to absorb light of a specific wavelength range.

A coloring layer is usually provided on a support in a position over a photographic emulsion layer when it is disired to control the spectral composition of a light incident upon the photographic emulsion layer.

Such a coloring layer is called a filter layer. If more than one photographic emulsion layer is present, a filter layer may be provided between the silver halide photographic material.

In order to prevent image fuzziness, that is, halation, an anti-halation layer may be provided in the silver halide photographic material. Halation is caused by light which is scattered in or after passing through a photographic emulsion layer, is reflected on the interface between the emulsion layer and support or a surface of a support opposite to the emulsion layer, and gets once again in the photographic emulsion layer. If more than one photographic emulsion layer is present in the silver halide photographic material, an anti-halation layer may be provided between silver halide emulsion layers.

A photographic emulsion layer may be colored in order to prevent deterioration of image sharpness (in general, this phenomenon is called irradiation) caused by scattering of light in the photographic emulsion layer.

Dyes are usually incorporated into these hydrophilic colloid layers for this purpose. These dyes must satisfy the following conditions:

(1) have an appropriate spectral absorption according to the particular application of the silver halide photographic material;

(2) be photochemically inactive, that is, exert no adverse chemical affects such sensitivity reduction, latent image degradation and fogging, on the silver halide photographic layer;

(3) be capable of being bleached during photographic processing or be capable of being eluted in a processing solution or rinsing water and leave no harmful residual color on a processed photographic material;

(4) not be diffused from a colored layer to another layer or layers; and (5) have excellent aging stability in solution or in a photographic material, that is, not be discolored and faded.

In particular, when the coloring layer is a filter layer or an anti-halation layer which is provided on the same side of a support as a photographic emulsion layer, in many cases it is necessary that those layers be selectively colored and that the other layers be substantially not colored. This is done in order to prevent a harmful spectral effect from being exerted on the other layers, and in order to not reduce the effectiveness of the filter or anti-halation layer. In order to prevent irradiation, only the emulsion layer may be colored, or else the problems discussed above arise. However, when the dye-containing layer is wet and contacts other hydrophilic layers, part of the dye diffusing from the dye-containing layer to the other layers. Many efforts have been made to prevent such dye diffusion.

For example, U.S. Pat. Nos. 2,548,564, 4,124,386 and 3,625,694 teach methods wherein a hydrophilic polymer having a charge opposite to a dissociated anionic dye is used as a mordant in a layer in order to localize the dye in a specific layer by means of a molecular interaction with the dye.

U.S. Pat. Nos. 2,719,088, 2,496,841, and 2,496,843, and JP-A-60-45237 (the term "JP-A"as used herein means an unexamined published Japanese patent application) teach methods wherein a specific layer is colored using metal salt fine particles adsorbed thereon with a dye. A specific layer may be colored by a water insoluble solid dye as disclosed in JP-A-55-120030, JP-A-56-12639, JP-A-55-155350, JP-A-55--155351, JP-A-63-27838, JP-A-63-197943, and JP-A-52-92716, European Patents 15,601, 323,729, 274,723, 276,566 and 299,435, and International Patent 88/04794.

However, there persists the problem of dye diffusion of a dye from a dye-fixed layer, and the problem that de-coloring speed during development processing is not satisfactory especially in view of recent advances in development processing speed, processing solution compositions and photographic emulsion compositions.

SUMMARY OF THE INVENTION

Accordingly, an object of the present invention is to provide a photographic light-sensitive material containing a dye dispersed in the form of solid fine particles, the dye coloring a specific layer in the photographic material, wherein the dye is quickly decolored during development processing and the dye does not diffuse into other layers during storage.

The above objective and other objectives of the present invention are achieved by a silver halide photographic material including a hydrophilic colloid layer containing at least one compound represented by the following formula (I) in the form of a solid fine particle dispersion:

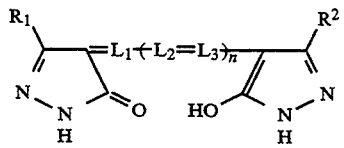

(I)

wherein n represents 0, 1 or 2; when n is 0 or 1, $R_1$ and $R_2$ each represents a hydrogen atom, a halogen atom, $NR_3COOR_4$, $NR_5SO_2R_4$, or $NR_3CSNR_3R_6$, wherein $R_3$ and $R_6$ each represents a hydrogen atom, an alkyl group, an aryl group, or a heterocyclic group; $R_4$ and $R_5$ each represents an alkyl group, an aryl group, or a heterocyclic group; and $R_3$ and $R_4$, $R_4$ and $R_5$, or $R_3$ and $R_6$ may be combined with each other to form a 5- or 6-membered ring; when n is 2, $R_1$ and $R_2$ each represents $NR_7COOR_8$, $NR_9SO_2R_8$, $NR_7CXNR_7R_{10}$, $SOR_8$, $SO_2R_8$, or $SR_8$, wherein $R_7$ and $R_{10}$ each represents a hydrogen atom, an alkyl group, an aryl group, or a heterocyclic group; $R_8$ and $R_9$ each represents an alkyl group, an aryl group, or a heterocyclic group; $R_7$ and $R_8$, $R_8$ and $R_9$, or $R_7$ and $R_{10}$ may be combined with each other to form a 5- or 6-membered ring; and X represents an oxygen atom or a sulfur atom; and $L_1$, $L_2$ and $L_3$each represents a methine group, provided that $R_1$, $R_2$, $L_1$, $L_2$, and $L_3$ do not have a group having a proton capable of being ionized.

DETAILED DESCRIPTION OF THE INVENTION

First, compounds of formula (I) (sometimes referred to herein as a "dye") will now be explained in detail.

The alkyl group represented by $R_3$, $R_4$, $R_5$, $R_6$, $R_7$, $R_8$, $R_9$, or $R_{10}$ is preferably an alkyl group having 1 to 8 carbon atoms, for example, a methyl group, an ethyl group, a n-propyl group, an isopropyl group, a n-butyl group, a sec-butyl group, a t-butyl group, an iso-butyl group, a n-pentyl group, a n-hexyl group, a n-heptyl group, a n-octyl group, a cyclohexyl group, a 2-ethylhexyl group, a 3-methylbutyl group, a cyclopentyl group, and a 2-ethylbutyl group, and this alkyl group may have a substituent, for example, a halogen atom, for example, F, Cl and Br, or a cyano group, a nitro group, a hydroxyl group, an amino group having 0 to 6 carbon atoms, for example, unsubstituted amino, dimethylamino, and diethylamino, or an alkoxy group having 1 to 8 carbon atoms, for example, phenoxy and p-methylphenoxy, or an aryl group having 6 to 10 carbon atoms, for example, phenyl and 2-chlorophenyl, or an ester group having 2 to 8 carbon atoms, for example, methoxycarbonyl and ethoxycarbonyl.

The aryl group represented by $R_3$, $R_4$, $R_5$, $R_6$, $R_7$, $R_8$, $R_9$, or $R_{10}$ is preferably an aryl group having 6 to 10 carbon atoms, for example, a phenyl group and a naphthyl group. This aryl group is more preferably phenyl and may have a substituent, for example, the groups discussed above in connection with the substituents of the alkyl group represented by $R_3$, $R_4$, $R_5$, $R_6$, $R_7$, $R_8$, $R_9$, or $R_{10}$, or an alkyl group having 1 to 4 carbon atoms, for example, methyl, ethyl, t-butyl, and n-propyl.

The heterocyclic group represented by $R_3$, $R_4$, $R_5$, $R_6$, $R_7$, $R_8$, $R_9$, or $R_{10}$ is preferably a pyridyl group, an imidazoyl group or a furyl group and may have a substituent, for example, the groups discussed above in connection with the substituents of the alkyl group represented by $R_3$, $R_4$, $R_5$, $R_6$, $R_7$, $R_8$, $R_9$, or $R_{10}$, or an alkyl group having 1 to 8 carbon atoms.

The 5- or 6-membered ring formed by combining $R_3$ and $R_4$, $R_4$ and $R_5$, $R_7$ and $R_8$, $R_8$ and $R_9$, $R_3$ and $R_6$, and $R_7$ and $R_{10}$, is preferably an oxazolidone ring, a 1-thia-2-aza-cyclohexane-1,1-dioxide ring, a 2-imidazolidone ring, a 2-imidazolinethione ring, a pyrrolidine ring, a piperidine ring, or a morpholine ring.

When n is 0 or 1, the preferred groups represented by $R_1$ and $R_2$ are $NR_3COOR_4$ and $NR_3CSNR_3R_6$, and when n is 2, the preferred groups represented by $R_1$ and $R_2$ are $NR_7COOR_8$ and $NR_7CXNR_7R_{10}$.

The methine group represented by $L_1$, $L_2$ and $L_3$ may be unsubstituted or may have a substituent, for example, a methyl group, an ethyl group, a benzyl group, a phenyl group, or chlorine. The methine groups may be combined to form a 5- or -membered ring, for example, a cyclopentene ring, a cyclohexene ring, a 1-chlorocyclohexene ring, a 1-dimethylaminocyclopentene ring, or a 1-morpholinocyclopentene ring.

In the foregoing, $R_1$, $R_2$, $L_1$ $L_2$ and $L_3$ do not have a proton capable of being ionized, i.e., a proton having a pKa of 4 to 11 in a mixed solution of water and ethanol (volume ratio: 1).

Examples of compounds represented by Formula (I) are shown in the following Table 1; however, the present invention will not be limited thereby.

TABLE 1

| dye | $R_1$ | $R_2$ | $=L_1\leftarrow L_2=L_3\rightarrow_n$ |
|---|---|---|---|
| I-1 | $-NHCOOC_3H_7(n)$ | $-NHCOOC_3H_7(n)$ | =CH— |
| I-2 | $-NHCOOC_4H_9(n)$ | $-NHCOOC_4H_9(n)$ | =CH— |
| I-3 | $-NHCOOC_6H_{13}(n)$ | $-NHCOOC_6H_{13}(n)$ | =CH— |
| I-4 | $-NHCOOC_8H_{17}(n)$ | $-NHCOOC_8H_{17}(n)$ | =CH— |
| I-5 | 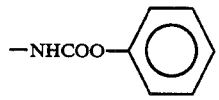 | 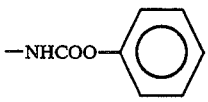 | =CH— |
| I-6 | $-N(CH_3)SO_2C_4H_9(n)$ | $-N(CH_3)SO_2C_4H_9(n)$ | =CH— |
| I-7 | $-N(CH_3)SO_2C_6H_{13}(n)$ | $-N(CH_3)SO_2C_6H_{13}(n)$ | =CH— |
| I-8 | 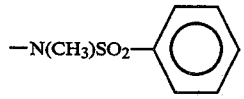 | 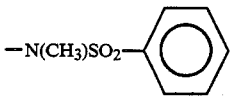 | =CH— |
| I-9 | $-NHCSNHC_4H_9(n)$ | $-NHCSNHC_4H_9(n)$ | =CH— |
| I-10 | 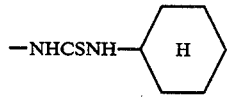 | 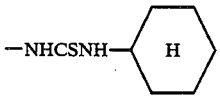 | =CH— |
| I-11 | Cl | Cl | =CH— |
| I-12 | $-NHCOOC_2H_5$ | $-NHCOOC_2H_5$ | =CH—CH=CH— |
| I-13 | $-NHCOOC_3H_7(n)$ | $-NHCOOC_3H_7(n)$ | =CH—CH=CH— |
| I-14 | $-NHCOOC_4H_9(n)$ | $-NHCOOC_4H_9(n)$ | =CH—CH=CH— |
| I-15 | $-NHCOOC_3H_7(i)$ | $-NHCOOC_3H_7(i)$ | =CH—CH=CH— |

TABLE 1-continued

| dye | $R_1$ | $R_2$ | $=L_1(L_2=L_3)_n$ |
|---|---|---|---|
| I-16 | 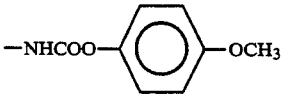 | 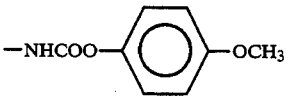 | =CH—CH=CH— |
| I-17 | 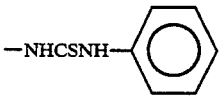 | 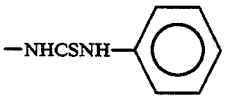 | =CH—CH=CH— |
| I-18 | $-NHCSNHCH_3$ | $-NHCSNHCH_3$ | =CH—CH=CH— |
| I-19 | $-N(CH_3)SO_2CH_3$ | $-N(CH_3)SO_2CH_3$ | =CH—CH=CH— |
| I-20 | $N(C_2H_5)SO_2SH_3$ | $N(C_2H_5)SO_2SH_3$ | =CH—CH=CH— |
| I-21 | $-NHCOOC_3H_7(n)$ | $-NHCOOC_3H_7(n)$ | $=CH(CH=CH)_2$ |
| I-22 | $-NHCOOC_4H_9(n)$ | $-NHCOOC_4H_9(n)$ | $=CH(CH=CH)_2$ |
| I-23 | $-NHCOOC_6H_{13}(n)$ | $-NHCOOC_6H_{13}(n)$ | $=CH(CH=CH)_2$ |
| I-24 | 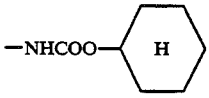 | 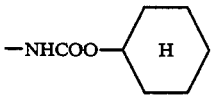 | $=CH(CH=CH)_2$ |
| I-25 | $-NHCOOC_3H_7(i)$ | $-NHCOOC_3H_7(i)$ | $=CH(CH=CH)_2$ |
| I-26 | 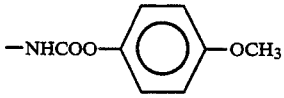 | 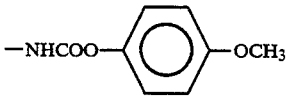 | $=CH(CH=CH)_2$ |
| I-27 | $-NHCONHCH_3$ | $-NHCONHCH_3$ | $=CH(CH=CH)_2$ |
| I-28 | $-NHCONHC_2H_5$ | $-NHCONHC_2H_5$ | $=CH(CH=CH)_2$ |
| I-29 | $-NHCONHC_4H_9$ | $-NHCONHC_4H_9$ | $=CH(CH=CH)_2$ |
| I-30 | 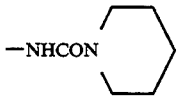 | 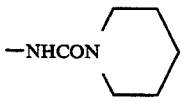 | $=CH(CH=CH)_2$ |
| I-31 | $-NHCSNHC_2H_5$ | $-NHCSNHC_2H_5$ | $=CH(CH=CH)_2$ |
| I-32 | $-NHCSNHC_4H_9$ | $-NHCSNHC_4H_9$ | $=CH(CH=CH)_2$ |
| I-33 | 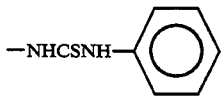 | 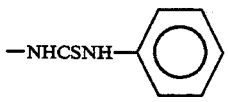 | $=CH(CH=CH)_2$ |
| I-34 | 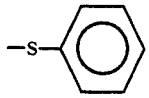 | 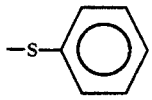 | $=CH(CH=CH)_2$ |
| I-35 | 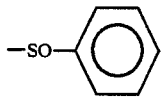 | 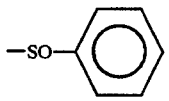 | $=CH(CH=CH)_2$ |

TABLE 1-continued

| dye | $R_1$ | $R_2$ | $=L_1\leftarrow L_2=L_3\rightarrow_n$ |
|---|---|---|---|
| I-36 | $-SO_2-$ 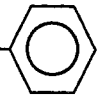 | $-SO_2-$ 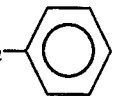 | $=CH\leftarrow CH=CH\rightarrow_2$ |
| I-37 | $-N(CH_3)SO_2CH_3$ | $-N(CH_3)SO_2CH_3$ | $=CH\leftarrow CH=CH\rightarrow_2$ |
| I-38 | $-N(CH_3)SO_2C_2H_5$ | $-N(CH_3)SO_2C_2H_5$ | $=CH\leftarrow CH=CH\rightarrow_2$ |
| I-39 | $-NHCOOC_4H_9(n)$ | $-NHCOOC_4H_9(n)$ | $=CH-\overset{CH_3}{\overset{\vert}{C}}=CH-$ |
| I-40 | Cl | $-NHCOOC_4H_9(n)$ | $=CH\leftarrow CH=CH\rightarrow_2$ |

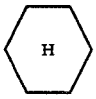

: cyclohexane ring

The dyes represented by formula (I) can be synthesized by conventional methods such as by a condensation reaction of a corresponding pyrazolone compound with a methine source, such as ethyl orthoformate, diphenylamidine, 1,1,3,3-tetramethoxypropane, malonaldehydedianyl, and glutaconaldehydedianyl. In particular, the dyes can be synthesized according to the methods disclosed in JP-A-52-92716, 63-316853, and 64-40827, and JP-B-58-35544 (the term "JP-B" as used herein means an examined Japanese patent publication), and according to the following examples.

SYNTHESIS EXAMPLE 1 (SYNTHESIS OF DYE I-2 )

A mixed suspending solution of 5.0 g of 3-butoxycarbonylamino-5-pyrazolone, 2.4 g of ethyl orthoformate, and 30 ml of DMF (dimethylformamide) was heated and stirred on a steam bath for 3 hours (inner temperature of 80° to 85° C.). After cooling the reaction solution down to room temperature, it was poured onto 120 ml of ice and water, and deposited crystal were filtered off, followed by sufficiently washing with water and drying, whereby 4.2 g of the compound I-2 was obtained.

$\lambda_{max}=429$ nm $\epsilon=1.38\times10^4$ (dimethylformamide)

SYNTHESIS EXAMPLE 2 (SYNTHESIS OF DYE I-6)

Example 1 was repeated except that the 3-butoxycarbonylamino-5-pyrazolone was replaced with 5.9 g of 3-butylsulfonylmethylamino-5-pyrazolone, whereby 5.1 g of the compound I-6 was obtained.

$\lambda_{max}=432$ nm $\epsilon=1.40\times10^4$ (dimethylforamide)

SYNTHESIS EXAMPLE 3 (SYNTHESIS OF DYE I-14)

A mixed solution of 5.0 g of 3-butoxycarbonylamino-5-pyrazolone, 3.1 g of malonaldehydedianyl hydrochlorate, 5.0 ml of triethylamine, and 30 ml of dimethylforamide, was stirred at room temperature for 4 hours. This reaction solution was cooled with ice ( inner temperature of 3° to 5 ° C. ) and then a mixed solution of 25 ml of 2N hydrochloric acid aqueous solution and 25 ml of methanol was gradually added thereto. After further stirring at room temperature for 30 minutes, crystals were filtered off and washed with methanol, followed by drying, whereby 6 . 0 g of compound 1-14 was obtained.

$\lambda_{max}=550$ nm $\epsilon_{max}=4.12\times10^4$ (dimethylformamide)

EXAMPLE 4 (SYNTHESIS OF DYE I-18)

Example 3 was repeated except that 3-butoxycarbonylamino-5-pyrazolone was replaced with 4.3 g of 3-methylureido-5-pyrazolone, whereby 2.8 g of the compound 1-18 was obtained.

$\lambda_{max}=548$ mn $\epsilon=4.16\times10^4$ (dimethylforamide)

EXAMPLE 5 (SYNTHESIS OF DYE I-22)

A mixed solution of 5.0 g of 3-butoxycarbonylamino-5-pyrazolone, 3 . 2 g of glutaconaldehydedianyl hydrochlorate, 5 . 0 ml of triethylamine, and 30 ml of dimethylforamide was stirred at room temperature for 5 hours. This reaction solution was cooled with ice (inner temperature of 3° to 5° C.) and then a mixed solution of 50 ml of 1N hydrochloric acid-methanol solution and 20 ml of water was gradually added thereto. After stirring at room temperature for 30 minutes, crystals were filtered off and washed with a 50 % methanol aqueous solution, followed by drying, whereby 3.8 g of the compound 1-22 was obtained.

$\lambda_{max}=650$ nm $\epsilon_{max}=9.85\times10^4$ (dimethylforamide)

Dyes represented by Formula (I) can be dispersed by any suitable conventional pulverizing method using for example, a ball mill, a vibration ball mill, a planetary ball mill, a sand mill, a colloid mill, a jet mill or a roller mill, wherein a solvent (e.g., water) is preferably used and a surface active agent in combination with the solvent is preferably used. After dissolving the dye of the present invention in a suitable solvent, a poor solvent for the dye of the present invention may be added thereto to precipitate a fine crystal. A surface active agent for forming the dispersion may also be used. Alternatively, the dye is first dissolved in a suitable solvent by controlling the pH of the dispersion, and then the pH of the dispersion is changed to precipitate a fine crystal.

Compounds represented by ForTnula (I) of the present invention preferably have average grain size up to 10 μm, more preferably up to 1 μm, most preferably up to 0.5 μm, with the preferred lower limit being 0.01 μm. The average grain size may be up to 0.1 μm in some applications.

The dye is preferably monodispersed. In dispersing a dye of formula (I), dye solid matter may be dispersed without subjecting it to any further treatment, wherein dye solid matter in a wet condition obtained by the manufacture of the dye is preferably used directly in forming a dispersion of the dye.

The dye of the present invention may be subjected to a heat treatment before and/or after forming a dispersion of the dye, if desired. The heat treatment is most effective if it is carried out at least after forming the dispersion.

A heat treatment is not specifically limited as long as heat is added to the dye solid matter. The temperature for the heat treatment is preferably at least 40° C., and the upper limit thereof is not limited so long as the dye is not decomposed. Preferably, the upper limit for the heat treatment is 250° C. The temperature of the heat treatment is more preferably from 50° to 150° C.

The dye may be heated for any suitable heating time so long as the dye is not decomposed. Preferably, the dye is heated for 15 minutes to one week, more preferably 1 hour to 4 days.

The heat treatment is preferably carried out in a solvent. The solvent may be any suitable solvent so long as it does not substantially dissolve the dye. Examples of suitable solvents include: water; alcohols, for example, methanol, ethanol, isopropyl alcohol, butanol, isoamyl alcohol, octanol, ethylene glycol, diethylene glycol, and ethyl cellosolve; ketones, for example, acetone and methyl ethyl ketone; esters, for example, ethyl acetate and butyl acetate; alkylcarboxylic acids, for example, acetic acid and propionic acid; nitriles, for example, acetonitrile; and ethers, for example, dimethoxyethane, dioxane and tetrahydrofuran).

Preferably, the heat treatment of the dye is carried out in the presence of one or more organic carboxylic acids. Examples of suitable carboxylic acids include: alkylcarboxylic acids, for example, acetic acid and propionic acid; carboxymethyl celluloses (CMC); and arylcarboxylic acids , for example, benzoic acid and salicylic acid. The organic carboxylic acid or acids may be utilized as the solvent for the heat treatment.

An organic carboxylic acid or mixture of organic carboxylic acids can be used in an amount which is 0.5 to 100 times the amount of the dye or dyes of Formula (I) when an organic carboxylic acid or acids are used as a solvent during the heat treatment. When a solvent other than an organic carboxylic acid is used in the heat treatment, the organic carboxylic acid may be used as an additive in an amount of 0.05 to 100 parts by weight per 100 parts by weight of the dye or dyes of Formula (I).

Any suitable amount of the dye represented by Formula (I) may be utilized in the present invention. The dye may be added to a hydrophilic layer or layers at any time before the layer is coated. Preferably, an amount of the dye is utilized so that the optical density of the layer containing the dye falls within the range of 0.05 to 3.0. The amount of the dye present in one hydrophilic clloid layer is preferably from 0.5 to 1000 mg/m$^2$, more preferably 1 to 500 mg/m$^2$.

The dye represented by Formula (I) may be used in any emulsion layer or other hydrophilic colloid layer such as an intermediate layer, a protective layer, an anti-halation layer or a filter layer. The dye may be utilized in a single layer or more than one layer.

Gelatin is a suitable hydrophilic colloid to which the dye may be added. Other suitable hydrophilic colloids which may contain the dye of the invention will be apparent to one skilled in the art.

Preferably, the silver halide emulsion utilized in the present invention is an emulsion of silver bromide, silver iodide, silver bromoiodide, silver bromochloroiodide, silver bromochloride or silver chloride.

The silver halide grains of a silver halide suitable for use in the present invention may be a regular crystal form such as cube or octahedron, an irregular form, such as a sphere or a plate, or a mixture of these crystal forms. Preferably, grains having a regular crystal form are utilized in the present invention. A suitable silver halide grain, photographic emulsion, technique for the preparation of a photographic emulsion, binder, protective colloid, hardener, sensitizing dye, stabilizer, and anti,fogging agent, which all may be utilized in the present invention are in the text described starting at the 18th line of the left lower column of page 18 and continuing through to the 17th line of the left lower column of page 20 of JP-A-3-238447.

The photographic material according to the present invention may contain one or more surface active agents used as a coating aid, for anti-electrification purposes, to improve sliding, as an emulsion dispersent, to reduce adhesiveness, or to improve other photographic characteristics, for example, speed of development, hardening of a gradation and sensitization.

The photographic material according to the present invention may contain a dye (other than the dye of the present invention) as a filter dye or for anti-irradiation, antihalation or other purposes. Preferably, this dye is an oxonol dye, a hemioxonol dye, a styryl dye, a merocyanine dye, an anthraquinone dye, or an azo dye. Other suitable dyes include a cyanine dye, an azomethine dye, a triarylmethane dye, and a phthalocyanine dye. When a water soluble dye is utilized for this dye, it can be added to the dye dispersion of the present invention after dissolving it in water. Non-water soluble dyes can be added to the dye dispersion of the present invention as a solid fine grain. It is also possible to utilize an oil soluble dye in a hydrophilic colloid layer containing the dye dispersion of the present invention after emulsifying the oil soluble dye in by an oil-in-water dispersion method.

A suitable multilayer and multicolor photographic material, support, method for coating a photographic emulsion, exposing device for a photographic material in accordance with the invention, and photographic processing technique for a photographic material in accordance with the invention, are all described in the text starting on the 14th line of the right lower column of page 20 to the 2nd line of the right upper column of page 27 of JP-A-3-238447.

The invention is further illustrated by the following examples which are set forth by may of illustration only and not by way of hivitation.

EXAMPLE 1

6 g of potassium bromide and 7 g of gelatin were added to 1 liter of water. 37 ml of a silver nitrate aqueous solution (silver nitrate: 4.00 g) and 38 ml of an aqueous solution containing 5.9 g of potassium bromide were added to the above solution which was maintained at 55° C. by a double jet method for 37 seconds while stirring. Next, 18.6 g of gelatin were added and then 89 ml of a silver nitrate aqueous solution (silver nitrate: 9.8 g) was added over a period of 22 minutes after the temperature was raised to 70° C. 7 ml of 25% ammonia aqueous solution was added for physical ripening for 10 minutes while maintaining the temperature at 55° C., then 6.5 ml of a 100% acetic acid solution was added. Subsequently, an aqueous solution of 153 g of silver nitrate and the aqueous solution of potassiumbromide were added by a controlled double jet method over a period of 35 minutes while maintaining pAg at 8.5. Then, 15 ml of a 2N potassium thiocyanate aqueous solution was added. After 5 minutes of physical ripening while maintaining the temperature at 55° C., the temperature was lowered to 35° C. Thus, there were obtained monodispersed pure silver bromide tabular grains having an average projected area-corresponding circle diameter of 1.10 μm, an average thickness of 0.165 μm, and a diameter fluctuation coefficient of 18.5%.

Thereafter, soluble salts were removed by a settling method. The temperature was raised to 40° C. and 30 g of gelatin, 2.35 g of phenoxy-ethanol, and 0.8 g of poly(-sodium styrenesulfonate) as a thickener, were added, followed by adjusting the pH and pAg to 5.90 and 8.25, respectively, with caustic soda and a silver nitrate solution.

This emulsion was subjected to a chemical sensitization while stirring and maintaining the temperature at 56° C. First, 0.043 mg of thiourea dioxide were added and the emulsion was left standing for 22 minutes for reduction sensitization. Then, there were added thereto 200 mg of 4-hydroxy-6-methyl-1,3,3a,7-tetraazaindene and 400 mg of the following sensitizing dye:

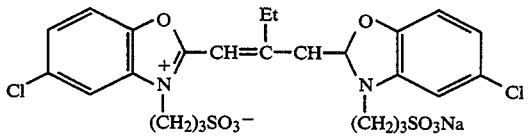

Further, 0.83 g of potassium chloride was added. Subsequently, 1.3 mg of sodium thiosulfate, 2.7 mg of selenium compound-1 (see below), 2.6 mg of chlorauric acid, and 90 mg of potassium thiocyanate were added, and the solution was cooled down to 35° C. 40 minutes later.

Thus, the tabular grains T-1 were prepared.

Selenium compound-1

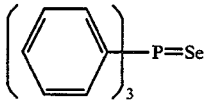

Preparation of a Coated Sample

The following compounds per mole of silver halide of T-1 were added to prepare coating solutions for preparing the coated samples.

| | |
|---|---|
| Gelatin (including gelatin contained in an emulsion) | 65.6 g |
| Trimethylol propane | 9 g |
| Dextran (average molecular weight: 39,000) | 18.5 g |
| Poly(sodium styrenesulfonate) (average molecular weight: 600,000) | 1.8 g |
| Hardener/1,2-bis(vinylsulfonylacetoamide)ethane (the amount was adjusted so that the swelling ratio became 230%) | |
| 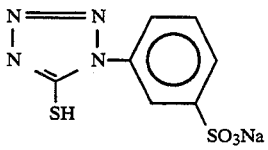 | 34 mg |
| 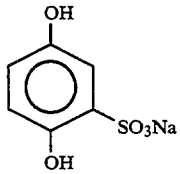 | 4.8 g |

A surface protective layer was coated so that the coated amounts of the respective components became as shown below:

| Composition of the surface protective layer: | Coated amount |
|---|---|
| Gelatin | 0.966 g/m² |
| Poly(sodium acrylate) (average molecular weight: 400,000) | 0.023 g/m² |
| 4-Hydroxy-6-methyl-1,3,3a,7-tetrazaindene | 0.015 g/m² |
| 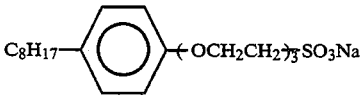 | 0.013 g/m² |
| $C_{16}H_{33}O(CH_2CH_2O)_{10}H$ | 0.045 g/m² |
| $C_{17}H_{33}CON(CH_3)CH_2CH_2SO_3Na$ | 0.0065 g/m² |
| $C_8F_{17}SO_2N(C_3H_7)(CH_2CH_2O)_{15}H$ | 0.003 g/m² |
| $C_8F_{17}SO_2N(C_3H_7)(CH_2CH_2O)_4(CH_2)_4SO_3Na$ | 0.001 g/m² |
| 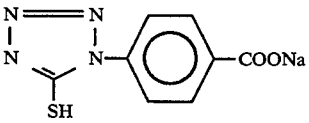 | 1.7 mg/m² |
| Polymethyl methacrylate (average grain size: 3.7 μm) | 0.087 g/m² |
| Proxel (pH was adjusted to 7.4 with NaOH) | 0.0005 g/m² |

PREPARATION OF SUPPORT

(1) Preparation of the Dye Dispersion D-1 for Coating a Subbing Layer

The dye (I-2) of the present invention was subjected to ball mill treatment by the method described below. 434 ml of water and 791 ml of 6.7% aqueous solution of surface active agent Triton X-200 (TX-200) were put in a 2 liter ball mill and 20 g of dye (I-2) were added to this solution. 400 ml of zirconium oxide (ZrO) beads having a 2 mm diameter were put in the ball mill and ball mill treatment was carried out for 4 days. Then, 160 g of a 12.5% gelatin aqueous solution was added and after defoaming, the mixture was filtered to remove the ZrO beads. Observation of the dye dispersion thus obtained showed that the particle sizes of the crashed dye were distributed in a wide range of 0.05 to 1.15 μm and that the average particle size was 0.37 μm.

Further, a centrifugal procedure was applied to remove the dye particles having a size of 0.9 μm or more. Thus, the dye dispersion D-1 was obtained.

(2) Preparation of Support

The surface of a biaxially stretched polyethylene terephthalate film with a thickness of 183 μm was subjected to a corona discharge treatment, and a first subbing layer coating solution having the following composition was coated thereon with a wire bar coater so that the coated amount became 5.1 ml/m², and dried at 175° C. for one minute.

Next, the first subbing layer was provided the opposite side of the support in the same manner. Polyethylene terephthalate containing 0.04wt % of a dye having the following chemical structure was used:

Coating solution composition:

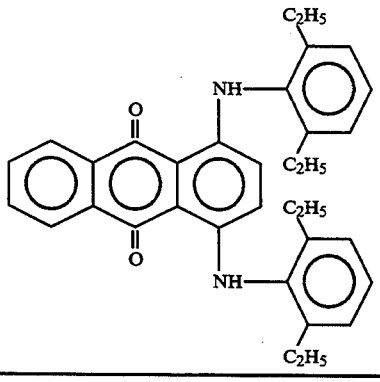

| | |
|---|---|
| Butadiene-styrene copolymer latex solution (solid content: 40%, butadiene/styrene weight ratio: 31/69) | 79 ml |
| $nC_6H_{13}OOCCH_2$ / $nC_6H_{13}OOCCH—SO_3Na$ | contained as an emulsion |
| dispersant in the latex solution in the proportion of 0.4 wt % based on the latex solid content | |
| Sodium 2,4-dichloro-6-hydroxy-s-triazine (4% solution) | 20.5 ml |
| Distilled water | 900.5 ml |

Second subbing layers having the following composition were applied on both of the above first subbing layers with a wire bar coater and dried at 150° C. one by one so that the coated amounts of the respective components became as shown below:

| | |
|---|---|
| Gelatin | 160 mg/m² |
| Dye dispersion D-1 (solid content of the dye) | 35 mg/m² |
| 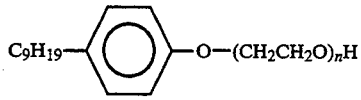 (n = 8.5) | 8 mg/m² |
| 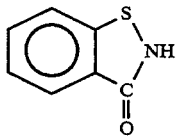 | 0.27 mg/m² |
| Matting agent (polymethyl methacrylate with an average grain size of 2.5 μm) | 2.5 mg/m² |

Preparation of a Photographic Material

The foregoing emulsion layer and surface protective layer were provided on both sides of the support prepared above by a simultaneous extrusion method to thereby prepare the photographic material 1-1 (see below). Further, the photographic materials 1-2 to 1-9 were prepared in the same manner as that of the photographic material 1-1, except that the solid fine particle dispersion contained in the second subbing layer was replaced with the dyes as shown in Table 2. The coated silver amount per one side was 1.75 g/m².

TABLE 2

| Photographic material | Dye | Coated amount on one side |
|---|---|---|
| 1-1 (Invention) | I-2 | 35 mg/m² |
| 1-2 (Invention) | I-14 | 35 mg/m² |
| 1-3 (Invention) | I-18 | 35 mg/m² |
| 1-4 (Invention) | I-19 | 35 mg/m² |
| 1-5 (Invention) | I-22 | 35 mg/m² |
| 1-6 (Invention) | I-29 | 35 mg/m² |
| 1-7 (Comparison) | *1 | 35 mg/m² |
| 1-8 (Comparison) | *2 | 35 mg/m² |
| 1-9 (Comparison) | — | — |

*1: Comparative dye 1.
*2: Comparative dye 2, which was dissolved to become even in dispersing.
Comparative dye 1: the compound described in JP-A-64-40827 (U.S. Pat. No. 4,855,221)

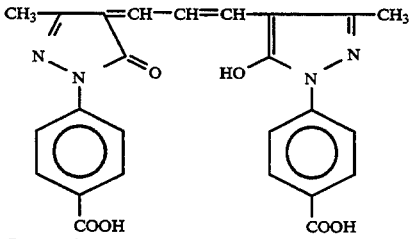

Comparative dye 2

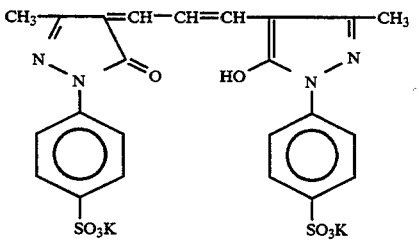

Evaluation of Photographic Performance

A GRENEX ortho screen HR-4 manufactured by Fuji Photo Film Co., Ltd. was tightly contacted to one side of the photographic material with the aid of a cassette and the photographic material was subjected to an X ray sensitometry. Exposure was adjusted by changing the distance between an X-ray tube and the cassette. After exposure, the photographic material was subjected to processing with an automatic processor in the following developing solution and fixing solution. Sensitivity was expressed by a value relative to that of the photographic material 1-9, which was set at 100.

Measurement of Sharpness (MTF)

The above cassette (the HR-4 screen was adhered to both sides thereof) and the processing with the automatic processor were combined to measure MTF. Measurement was carried out at an aperture of 30 $\mu m \times 500$ $\mu m$ and sharpness was evaluated at the portion having an optical density of 1.0 with an MTF value having the space frequency of 1.0 cycle/mm.

Measurement of Residual Color

An unexposed photographic film was subjected to the processing with the above automatic processor, and then the green color transmission density thereof was measured through a Macbeth status A filter. Meanwhile, a non-subbed blue-colored polyethylene terephthalate support was subjected to the measurement of green color transmission density, and the net value obtained by deducting the latter value from the former one was evaluated as a residual color density value.

The automatic processor used for this experiment was the automatic processor Model FPM-9000 manufactured by Fuji Photo Film Co., Ltd., which was modified so as to include an infrared dryer in the drying unit, and the processing steps therefor are as shown in the following Table 3. The average processing amount of a photographic material is 200 sheets (in terms of a sheet having a size of $12 \times 10$ inch) per day.

TABLE 3

| Processing step | Amount of solution in processing bath | Temperature | Path length | Time |
|---|---|---|---|---|
| Development | 15 liter | 35° C. | 613 mm | 8.8 sec |
| (Solution surfave area to processing bath volume ratio = 25 $cm^2$/liter | | | | |
| Fixing | 15 liter | 32° C. | 539 mm | 7.7 sec |
| Rinsing | 13 liter | 17° C. Flowing water | 263 mm | 3.8 sec |
| Squeeze | | | 304 mm | 4.4 sec |
| Drying | | 58° C. | 368 mm | 5.3 sec |
| Total | | | 2087 mm | 30.0 sec |

The processing solutions and replenishing solutions therefor are as follows:

Development Processing

| Preparation of the condensed solutions: | |
|---|---|
| Developing solution: | |
| Part agent A | |
| Potassium hydroxide | 330 g |
| Potassium sulfite | 630 g |
| Sodium sulfite | 255 g |
| Potassium carbonate | 90 g |
| Boric acid | 45 g |

-continued

| Preparation of the condensed solutions: | |
|---|---|
| Diethylene glycol | 180 g |
| Diethylenetriaminepeantacetic acid | 30 g |
| 1-(N,N-diethylamino)-ethyl-5-mercapto-tetrazole | 0.75 g |
| Hydroquinone | 450 g |
| 4-Hydroxymethyl-4-methyl-1-phenyl-3-pyrazolidone | 40 g |
| Water was added to | 4125 ml |
| Part agent B | |
| Diethylene glycol | 525 g |
| 3-3'-Dithiobishydrocinnamic acid | 3 g |
| Glacial acetic acid | 102.6 g |
| 5-Nitroindazole | 3.75 g |
| 1-Phenyl-3-pyrazolidone | 65 g |
| Water was added to | 750 ml |
| Part agent C | |
| Glutaraldehyde (50 wt/wt %) | 150 g |
| Potassium bromide | 15 g |
| Potassium metabisulfite | 105 g |
| Water was added to | 750 ml |
| Fixing solution: | |
| Ammonium thiosulfate (70 wt/vol %) | 3000 ml |
| Disodium ethylenediaminetetraacetate dihydrate | 0.45 g |
| Sodium sulfite | 225 g |
| Boric acid | 60 g |
| 1-(N,N-dimethylamino)-ethyl-5-mercapto-tetrazole | 15 g |
| Tartaric acid | 48 g |
| Glacial acetic acid | 675 g |
| Sodium hydroxide | 225 g |
| Sulfuric acid (36 N) | 58.5 g |
| Aluminum sulfate | 150 g |
| Water was added to | 600 ml |
| pH | 4.68 |

Preparation of the Processing Solutions

The above condensed developing solution was added to the following vessel by each part agent. This vessel included the respective part vessels of the part agents A, B and C with the vessels themselves so as to make one vessel.

The above fixing solution was added to a similar vessel.

An aqueous solution containing 54 g of acetic acid and 55.5 g of potassium bromide as a starter was added to a developing bath.

The upsided-down vessels containing the above processing solutions were inserted in the drilling blades of the processing solution stock tanks to break the sealing membranes provided on the caps thereof, and the respective processing solutions in the vessels were added to the stock tanks.

The processing solutions were added to the developing bath and fixing bath of the automatic processor in the following ratio by operating pumps of the automatic processor.

Further, every time eight sheets (in terms of $12 \times 10$ $inch^2$ sheet) of a photographic material was processed, undiluted processing solutions and water were mixed in the following ratio replenish to the processing baths in the automatic processor.

| | |
|---|---|
| Developing solution: | |
| Part agent A | 55 ml |
| Part agent B | 10 ml |
| Part agent C | 10 ml |
| Water | 125 ml |
| pH | 10.50 |
| Fixing solution: | |

-continued

| | |
|---|---|
| Condensed solution | 80 ml |
| Water | 120 ml |
| pH | 4.62 |
| City water was added to a rinsing bath. | |
| The results are shown in Table 4. | |

TABLE 4

| Photographic material | Dye | Relative*3 sensitivity | MTF | Residual color |
|---|---|---|---|---|
| 1-1 (Invention) | I-2 | 100 | 0.56 | 0.01 |
| 1-2 (Invention) | I-14 | 100 | 0.56 | 0.02 |
| 1-3 (Invention) | I-18 | 100 | 0.56 | 0.01 |
| 1-4 (Invention) | I-19 | 100 | 0.56 | 0.01 |
| 1-5 (Invention) | I-22 | 100 | 0.56 | 0.01 |
| 1-6 (Invention) | I-29 | 100 | 0.56 | 0.01 |
| 1-7 (Comparison) | *1 | 88 | 0.55 | 0.03 |
| 1-8 (Comparison) | *2 | 80 | 0.56 | 0.03 |
| 1-9 (Comparison) | — | 100 | 0.42 | 0.00 |

*1: Comparative dye 1.
*2: Comparative dye 2.
*3: Relative sensitivity on a front side.

It will be appreciated from the results summarized in the above Table 4 that the use of the dyes of the present invention provide a photographic material which has the less reduction of sensitivity and excellent sharpness as well as less residual color.

EXAMPLE 2

The silver halide photographic material 2-1 was prepared by the method described on the seventh line of a left lower column at page 24 to the twentieth line of a left lower column at page 25 of JP-A-3-249752, provided that the dye I-1 described on the eighteenth line of a left upper column at page 24 of the above publication was replaced with the dispersion prepared by dispersing the dye 1-12 of the present invention by the same method as that in Example 1 (the amount of 1-9 was 140 mg/m$^2$). The photographic materials 2-2 to 2-15 were prepared in the same manner as that of photographic material 2-1 except that the dye 1-12 was replaced with the dyes described in Table 5.

After storing the samples thus obtained at 40° C. and 80% RH for 3 days, they were subjected to the processing described in the table on the eighth line of a right lower column at page 25 to a left upper column at page 26 of the above publication and the differences in the sensitivity between the samples after storing and the samples subjected to the same processing without storing were obtained as a desensitization degree. The results thereof are shown in Table 5.

TABLE 5

| Sample | Dye | Desensitization degree |
|---|---|---|
| 2-1 (Invention) | I-12 | 0.04 |
| 2-2 (Invention) | I-14 | 0.04 |
| 2-3 (Invention) | I-17 | 0.03 |
| 2-4 (Invention) | I-18 | 0.03 |
| 2-5 (Invention) | I-19 | 0.03 |
| 2-6 (Invention) | I-22 | 0.03 |
| 2-7 (Invention) | I-25 | 0.04 |
| 2-8 (Invention) | I-29 | 0.03 |
| 2-9 (Invention) | I-30 | 0.03 |
| 2-10 (Invention) | I-32 | 0.04 |
| 2-11 (Invention) | I-36 | 0.03 |
| 2-12 (Invention) | I-38 | 0.03 |
| 2-13 (Comparison) | *1 | 0.18 |
| 2-14 (Comparison) | *2 | 0.16 |

TABLE 5-continued

| Sample | Dye | Desensitization degree |
|---|---|---|
| 2-15 (Comparison) | None | 0.03 |

*1: Comparative dye 1.
*2: Comparative dye 2.

It will be appreciated from the results summarized in the above Table 5 that Samples 2-1 to 2-12 to which the dyes of the present invention were added have less desensitization even after storage as compared with Comparative Samples 2-13 and 2-14 to which the conventional dyes were added. While Comparative Samples 2-13 and 2-14 had a blue residual color after processing, Samples 2-1 to 2-12 to which the dyes of the present invention were added had no residual color and therefore have excellent decoloring performance. Further, Samples 2-1 to 2-14 to which the dyes were added had better sharpness than that of Sample 2-15 to which the dye was not added.

While the invention has been described in detailed with reference to specific embodiments, it will be apparent to one skilled in the art that various changes and modifications can be made to the invention without departing from its spirit and scope.

What is claimed is:

1. A silver halide photographic material, comprising a hydrophilic colloid layer comprising at least one compound represented by formula (I) in the form of a solid fine particle dispersion:

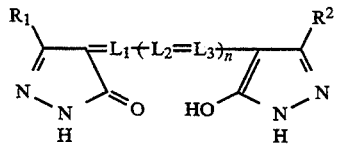

(I)

wherein n represents 0, 1 or 2;

when n is 0 or 1: $R_1$ and $R_2$ each represents a hydrogen atom, a halogen atom, $NR_3COOR_4$, $NR_5SO_2R_4$, or $NR_3CSNR_3R_6$, wherein $R_3$ and $R_6$ each represents a hydrogen atom, an alkyl group an aryl group, or a heterocyclic group; $R_4$ and $R_5$ each represents an alkyl group, an aryl group, or a heterocyclic group; or $R_3$ and $R_4$, $R_4$ and $R_5$, or $R_3$ and $R_6$ may combine to form a 5- or 6-membered ring;

when n is 2: $R_1$ and $R_2$ each represents $NR_7COOR_8$, $NR_9SO_2R_8$, $NR_7CXNR_7R_{10}$, $SOR_8$, or $SR_8$, wherein $R_7$ and $R_{10}$ each represents a hydrogen atom, an alkyl group, an aryl group, or a heterocyclic group; $R_8$ and $R_9$ each represents an alkyl group, an aryl group, or a heterocyclic group; or $R_7$ and $R_8$, $R_8$ and $R_9$, or $R_7$ and $R_{10}$ may combine to form a 5- or 6-membered ring;

X represents an oxygen atom or a sulfur atom; and $L_1$, $L_2$ and $L_3$ each represents a methine group, and $L_1$, $L_2$ and $L_3$ may be combined to form a 5- or 6-membered ring, provided that $R_1$, $R_2$, $L_1$, $L_2$ and $L_3$ do not include a group having a proton capable of being ionized.

2. The photographic material according to claim 1, wherein $R_3$, $R_4$, $R_5$, $R_6$, $R_7$, $R_8$, $R_9$ or $R_{10}$ is an unsubstituted or substituted alkyl group having 1 to 8 carbon atoms.

3. The photographic material according to claim 2, wherein the unsubstituted or substituted alkyl group is an alkyl group selected from the group consisting of a methyl group, an ethyl group, an n-propyl group, an isopropyl group, an n-butyl group, a sec-butyl group, a t-butyl group, an isobutyl group, an n-pentyl group, an n-hexyl group, an n-heptyl group, an n-octyl group, a cyclohexyl group, a 2-ethylhexyl group, a 3-methylbutyl group, a cyclopentyl group and a 2-ethylbutyl group.

4. The photographic material according to claim 2, wherein $R_3$, $R_4$, $R_5$, $R_6$, $R_7$, $R_8$, $R_9$ or $R_{10}$ is a substituted alkyl group having 1 to 8 carbon atoms, the substituent being a group selected from the group consisting of a halogen atom, a cyano group, a nitro group, a hydroxyl group, an amino group having up to 6 carbon atoms, an alkoxy group having 1 to 8 carbon atoms, an aryl group having 6 to 10 carbon atoms and an ester group having 2 to 8 carbon atoms.

5. The photographic material according to claim 1, wherein $R_3$, $R_4$, $R_5$, $R_6$, $R_7$, $R_8$, $R_9$ or $R_{10}$ is an unsubstituted or substituted aryl group having 6 to 10 carbon atoms.

6. The photographic material according to claim 5, wherein the aryl group is an aryl group selected from the group consisting of a phenyl group and a naphthyl group.

7. The photographic material according to claim 5, wherein $R_3$, $R_4$, $R_5$, $R_6$, $R_7$, $R_8$, $R_9$ or $R_{10}$ is a substituted aryl group having 6 to 10 carbon atoms, the substituent being a group selected from the group consisting of a halogen atom, a cyano group, a nitro group, a hydroxyl group, an amino group having up to 6 carbon atoms, an alkoxy group having 1 to 8 carbon atoms, an aryl group having 6 to 10 carbon atoms, an ester group having 2 to 8 carbon atoms and an alkyl group having 1 to 4 carbon atoms.

8. The photographic material according to claim 1, wherein $R_3$, $R_4$, $R_5$, $R_6$, $R_7$, $R_8$, $R_9$ or $R_{10}$ is a heterocyclic group selected from the group consisting of a substituted or unsubstituted pyridyl group, a substituted or unsubstituted imidazoyl group and a substituted or unsubstituted furyl group.

9. The photographic material according to claim 1, wherein $L_1$, $L_2$ and $L_3$ are combined to form a 5- or 6-membered ring.

10. The photographic material according to claim 1, wherein the 5- or 6-membered ring formed by combining $L_1$ or $L_2$ and $L_3$ is a ring selected from the group consisting of a cyclopentene ring, a cyclohexane ring, a 1-chlorocyclohexene ring, a 1-dimetyl-aminocyclopentene ring or a 1-morpholinocyclopentene ring.

11. The photographic material according to claim 1, wherein $L_1$, $L_2$ and $L_3$ is a substituted methine group, the substituent being a group selected from the group consisting of a methyl group, an ethyl group, a benzyl group, a phenyl group and a chlorine atom.

12. The photographic material according to claim 1, wherein the at least one compound of formula (I) has an average particle size of up to 10 $\mu$m.

13. The photographic material according to claim 12, wherein the at least one compound of formula (I) has an average particle size of from 0.01 to 1 $\mu$m.

14. The photographic material according to claim 1, wherein the at least one compound of formula (I) is present in the hydrophilic colloid layer in an amount from 0.5 to 1,000 mg/m$^2$.

15. The photographic material according to claim 1, wherein the at least one compound of formula (I) is subjected to a heat treatment before and/or after forming a dispersion of the at least one compound of formula (I), the heat treatment being conducted at a temperature of from 40° to 250° C. for 15 minutes to one week.

16. The photographic material according to claim 15, wherein the heat treatment is conducted in the presence of an organic carboxylic acid.

17. The photographic material according to claim 1, wherein n is 0 or 1.

18. The photographic material according to claim 1, wherein n is 2.

* * * * *